United States Patent [19]

Granberg et al.

[11] Patent Number: 4,721,456

[45] Date of Patent: Jan. 26, 1988

[54] COMBUSTION ELEMENT FOR A RADIANT ENERGY BURNER AND METHOD OF MAKING SAME

[75] Inventors: Dirk N. Granberg, El Paso, Tex.; John P. Eising, Oconomowoc, Wis.

[73] Assignee: A. O. Smith Corporation, Milwaukee, Wis.

[21] Appl. No.: 860,787

[22] Filed: May 8, 1986

[51] Int. Cl.[4] ..... F23D 14/12; B21D 53/00

[52] U.S. Cl. ..... 431/328; 29/157 C; 29/428; 29/DIG. 25

[58] Field of Search ..... 29/157 C, 157 R, 428, 29/439, 445, DIG. 25; 431/326, 327, 328, 329

[56] References Cited

U.S. PATENT DOCUMENTS 4,500,283 2/1985 Smith ..... 431/328

4,599,066 7/1986 Granberg ..... 431/329

*Primary Examiner*—P. W. Echols

*Assistant Examiner*—Ronald S. Wallace

*Attorney, Agent, or Firm*—Andrus, Sceales, Starke & Sawall

[57] ABSTRACT

An improved combustion element for a radiant energy burner. The element comprises a generally cylindrical metal screen having its outer end closed off by an end closure, while the inner end is connected to a source of gaseous fuel. Strands of ceramic material are braided directly on the outer surface of the screen to form a braided sleeve which is snugly fitted over the entire periphery of the screen.

8 Claims, 3 Drawing Figures

COMBUSTION ELEMENT FOR A RADIANT ENERGY BURNER AND METHOD OF MAKING SAME

BACKGROUND OF THE INVENTION

Radiant energy burners employ a combustion element which is permeable to the gaseous fuel and the fuel is burned in a flameless type of combustion on the outer surface of the element to principally emit radiant energy. In burners of this type, it is important to control the porosity and back pressure of the combustion element in order to obtain the proper combustion efficiency and minimize the possibility of "blowback" or flame lifting from the surface of the burner.

In the past, a form of radiant combustion element has consisted of an inner metal screen covered with a layer of randomly disposed short ceramic fibers. Elements of this type have been produced by immersing the screen in a molding tank containing a liquid slurry of the ceramic fibers and then drawing a vacuum through the screen, with the result that the fibers are deposited as a layer on the screen. The resulting vacuum-formed layer of ceramic fibers is fragile and is highly susceptible to damage during shipment and handling.

During use, the short fibers in the vacuum formed layer tend, with time, to dissociate which results in the combustion element having a non-uniform porosity, thereby decreasing the efficiency of the combustion and the useful life of the burner.

Furthermore, if the vacuum formed fibrous coating is broken away, either by damage or during usage, an outage can result in which a flame sensor will shut down the system due to a significant change in combustion pattern. While an outage is not a dangerous situation, it is a nuisance problem.

To provide protection for the fragile vacuum formed coating, attempts have been made in the past to enclose the combustion element in an outer protective sleeve, such as described in U.S. Pat. Nos. 3,275,497 and 3,179,156. However, the use of an outer protective screen substantially reduces the efficiency of the radiant heating operation and adds unnecessary cost.

In an attempt to overcome the problems associated with a vacuum formed coating, U.S. patent application Ser. No. 06/792,165, filed Oct. 25, 1985, now U.S. Pat. No. 4,599,066 issued July 8, 1986, discloses a combustion element comprising a generally cylindrical metal screen or support, and a woven fabric sleeve composed of ceramic fibers is disposed around the screen. A blower supplies a gaseous fuel mixture to the interior of the cylindrical support and the mixture flows outwardly through the support and through the fabric where it is combusted on the outer surface of the fabric to emit primarily a radiant form of energy.

The woven ceramic fabric has distinct advantages over a vacuum formed coating, in that the woven fabric is flexible, not brittle, and is thereby durable and can be handled without damage. Further, the fabric is composed of continuous fibers, so there is no loss of fibrous content in usage, with the result that the useful life of the fabric is prolonged.

In producing the combustion element as disclosed in the aforementioned U.S. Pat. No. 4,599,066, the sleeve is separately woven in cylindrical form and then slipped over the support or screen. Due to irregularities in the contour of the support, certain areas of the sleeve may fit loosely to the support, while other areas will fit snugly.

It is important in a combustin element for a radiant energy burner, that the velocity of the gas mixture is greater than the velocity of propagation of the flame back into the interior of the supporting screen. The velocity of the gas passing through a loosened area of woven fabric is reduced, so that it is possible to get progagation back into the sleeve in the loosened areas. Propagation of flame into the screen will overheat the screen and could eventually destroy the burner. To eliminaate this problem and obtain uniform conditions, it is necessary to provide an extremely snug fit between the woven ceramic sleeve and the inner screen or support.

SUMMARY OF THE INVENTION

The invention is directed to an inexpensive combustion element for a radiant energy burner which provides improved efficiency for the combustion operation. In accordance with the invention, the combustion element comprises a cylindrical metal screen or support and the supporting screen is formed with a circumferential groove adjacent its inner end where it is attached to a mounting flange, while the outer end of the screen is enclosed by a cap having a central depression or well. Strands of ceramic fiber are braided directly on the outer surface of the support and in the braiding operation, the ceramic material is initially braided onto the screen at a location downstream of the groove. The braiding then continues in an upstream direction across the groove to the inner end of the screen and the braiding is then reversed and continued down to and beyond the outer end of the screen. The double layer of braided ceramic material, extending within the groove, serves to securely anchor the inner end of the braided sleeve to the screen without the need of auxiliary fasteners.

The projecting outer end of the braided sleeve is tucked into the well in the end cap and secured therein by a cup.

By braiding the ceramic material directly on the supporting screen, a snug fit is obtained for the sleeve throughout its entire length, regardless of any irregularities in the contour of the screen.

With the snug fit of the sleeve, uniform gas flow and/or pressure drop is obtained over the entire surface of the combustion element, thereby eliminating hot and cold spots and achieving a uniform flame pattern to provide more uniform combustion.

The combustion element of the invention is less expensive than conventional types, in that it eliminates the need for any auxiliary clamping bands or fasteners, and substantially reduces the amount of scrap of the ceramic sleeve.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
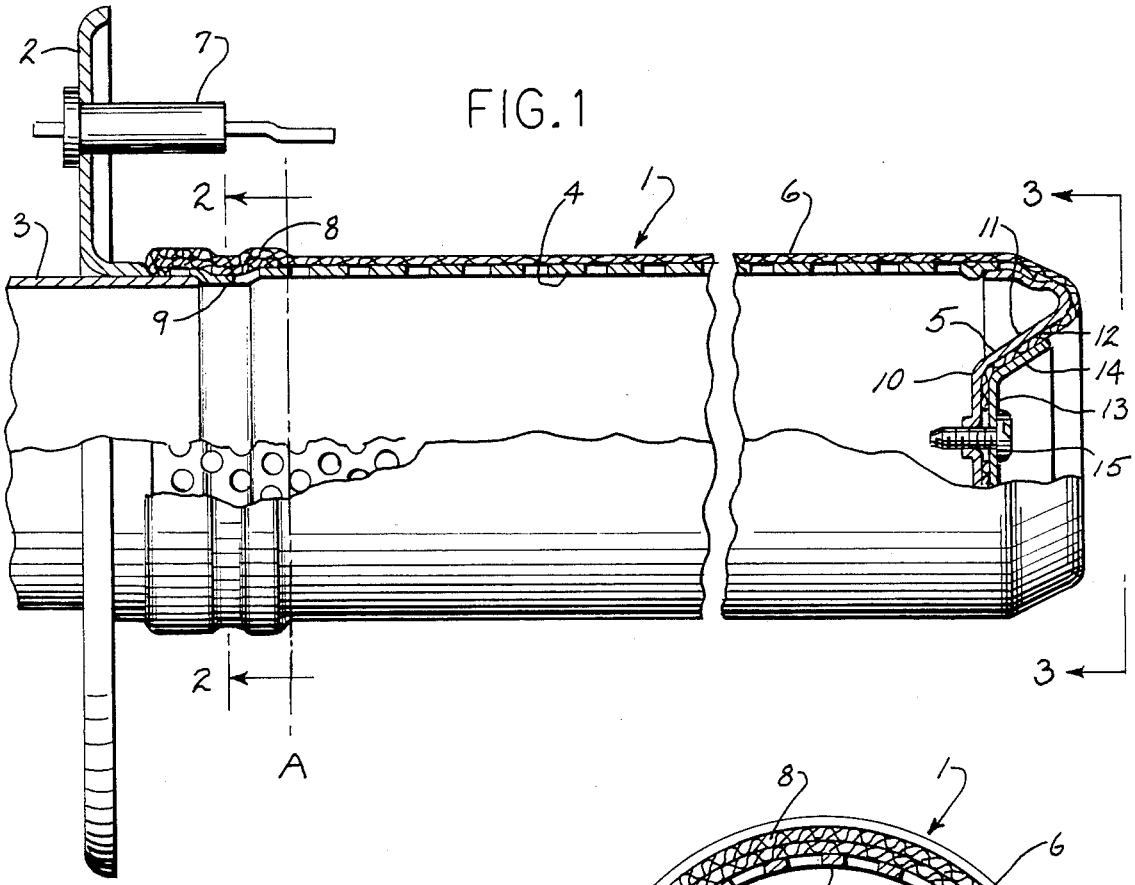
FIG. 1 is a side elevation of a combustion element for a radiant energy heater with parts broken away.
Figure 2:
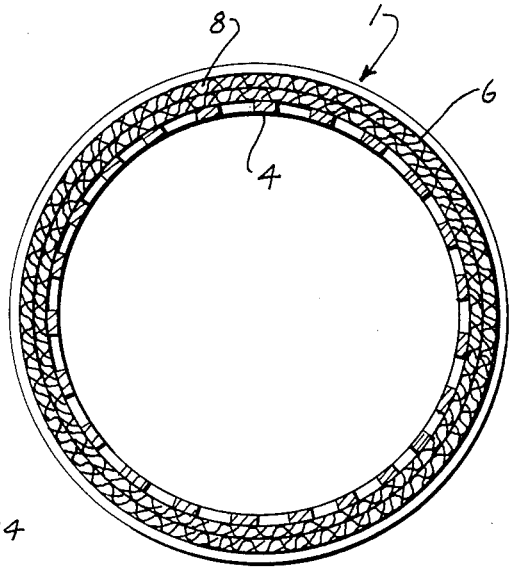
FIG. 2 is a section taken along line 2—2 of FIG. 1.
Figure 3:
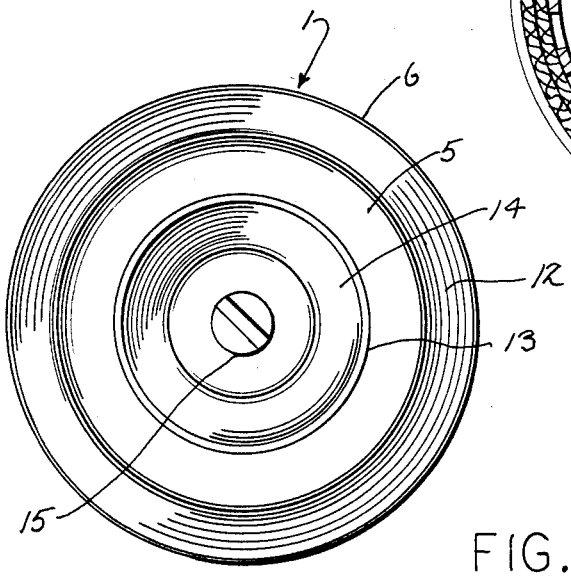
FIG. 3 is an end view of the combustion element.

FIG. 1 illustrates a combustion element 1 to be used in a radiant energy burner. The combustion element includes a mounting flange 2 which is adapted to be connected to a suitable supporting structure or housing and is attached to an inlet conduit 3 through which a mixture of gaseous fuel and air is supplied.

A generally cylindrical porous or foraminous metal support or screen 4 is secured around the end of conduit 3 and extends outwardly from mounting flange 2. The outer end of screen 4 is closed off by an end closure 5.

In accordance with the invention, a ceramic fibrous sleeve 6 is braided around the screen 4. Sleeve 6 is formed of continuous ceramic fibers capable of withstanding temperatures in excess of 1800° F. As an example, the sleeve can be braided from strands composed of ceramic fibers sold under the name of Nextel (3M Company), which are continuous polychrystalline metal oxide fibers, with the metal oxides consisting by weight of about 62% aluminum oxide, about 14% boron oxide, and about 24% silicon dioxide.

The gaseous fuel mixture, which can be a mixture of air and a gas, such as natural gas, propane, or the like, is introduced into the interior of the screen 4 through an inlet conduit 3 by a conventional blower, not shown, which provides the necessary pressure to force the fuel mixture through the braided sleeve 6.

The fuel is ignited on the outer surface of the sleeve by a standard igniter unit 7. The result is a flameless type of combustion on the outer surface of the braided sleeve 6, which principally results in the emission of radiant energy.

As illustrated in FIG. 1, braided sleeve 6 is provided with an inner double-backed section 8 and both the section 8 and the main portion of sleeve 6 extend within a circumferential groove 9 formed in the inner end of screen 4 adjacent the end of conduit 3.

The outer end of braided sleeve 6 extends beyond the outer end of screen 4 and is folded around the end closure 5. As shown in FIG. 1, end closure 5 is provided with a central well 10 bordered by a tapered wall 11. The outer end 12 of sleeve 6 is tucked in central well 10 and secured therein by a cup 13 having a tapered wall 14 which mates with tapered wall 11 of end closure 5. Cup 13 is secured to end closure 5 by a screw 15.

In fabricating the combustion element of the invention, the inner end of the screen is intially welded to flange 2 and to conduit 3. The screen 4 is then positioned vertically and strands of ceramic material are braided around the sleeve in a conventional manner. The braiding begins at station line A, which is located downstream of groove 9. The braiding then proceeds toward the inner end of screen 4 passing across groove 9. The braiding is then reversed and proceeds in a downstream direction along the length of the screen and beyond the outer end of the screen to form the braided sleeve. The portion 12 of the braided sleeve 6 projecting outwardly of the outer end of screen 4 necks down and is tucked in agaisnt the end closure 5. Cup 13 is then positioned against end closure 5 to secure the outer end of the sleeve to the screen.

By braiding the ceramic material directly on the screen, all areas of the sleeve are in snug engagement with the screen regardless of any irregularities in the screen. This ensures that there will be uniform gas flow and/or pressure drop over the entire surface of the combustion element to provide uniform cmbustion characteristics without hot or cold spots.

As the braiding passes into the groove 9, a secure mechanical interlock is obtained between the inner end of the sleeve and the screen. This results in a less expensive constructin in that no auxiliary clamping members are required to clamp the inner end of the braided sleeve to the screen.

Various modes of carrying out the invention are contemplated as being within the scope of the following claims particulary pointing out and distinctly claiming the subject matter which is regarded as the invention.

We claim:

1. In a radiant energy burner, a combustion element comprising a porous metal support having an inner end disposed to be connected to a source of gaseous fuel and having an outer end, an end closure closing off said outer end, said support having a circumferential groove disposed adjacent said inner end, a sleeve of ceramic fibers braided directly on the outer surface of said support and extending within said groove, the portion of said sleeve disposed in said groove being free of external clamping means, an outer end of said sleeve projecting beyond the outer end of said screen, and attaching means for attaching the outer end of the sleeve to said end closure.

2. In a radiant energy burner, a combustion element comprising a porous metal support having an inner end disposed to be connected to a source of gaseous fuel and having an outer end, an end closure closing off said outer end, said support having a circumferential groove disposed adjacent said inner end, a braided sleeve of ceramic fibers snugly disposed on the entire outer surface of said support, said sleeve extending within said groove, the portion of said sleeve disposed in said groove being free of external clamping means, and attaching means for attaching the outer end of the sleeve to said end closure.

3. The burner of claim 2, wherein said metal support is generally cylindrical in shape and constitutes a metal screen.

4. The burner of claim 2, wherein said braided sleeve comprises an inner section extending from a location immediately downstream of said groove to the inner end of said screen and said sleeve also includes an outer section which is disposed in overlapping relation to said inner section and extends the full length of said screen from said inner end to said outer end, both said inner section and said outer section being disposed in said groove.

5. The burner of claim 2, wherein said sleeve has a greater length than said support, the outer end portion of said sleeve being folded inwardly against said end closure, and clamping means for clamping said end portion against said end closure.

6. A method of making a combustion element for a radiant energy burner, comprising the steps of forming an open ended foraminous metal cylindrical support, said support having an inner end disposed to be connected to a source of a gaseous fuel and having an outer end, closing off the outer end of said support with an end closure, braiding strands of a ceramic material directly on the outer surface of the support adjacent said inner end, continuing the braiding along the length of the support and beyond the outer end to form a braided sleeve, with the outer end of the sleeve projecting beyond the outer end of said support, and attaching said projecting end of the sleeve to said end closure.

7. The method of claim 6, and including the step of forming a circumferential groove in the support adjacent said inner end, and braiding said ceramic material directly into said groove to provide a mechanical interlock between the braided sleeve and the support.

8. A method of making a combustion element for a radiant energy burner, comprising the steps of forming an open-ended generally cylindrical porous metal screen, said screen having an inner end and an outer end, forming a circumferential groove in said screen adjacent said inner end, connecting said inner end of the screen to a supply means for supplying a fuel-air mixture to the interior of the screen, closing off the outer end of the screen with an end closure, braiding strands of a ceramic material directly on the outer surface of said screen adjacent said inner end, braiding said ceramic material into said groove and continuing the braiding along the length of said screen and beyond the outer end of said screen to form a braided sleeve with the outer end of said sleeve projecting beyond the outer end of said screen, and attaching the outer end of said sleeve to said end closure.

* * * * *